US005668519A

United States Patent [19]

Yamashita

[11] Patent Number: 5,668,519

[45] Date of Patent: Sep. 16, 1997

[54] MAGNET ROLL AND METHOD OF PRODUCING SAME

[75] Inventor: Keitaro Yamashita, Saitama-ken, Japan

[73] Assignee: Hitachi Metals Ltd., Tokyo, Japan

[21] Appl. No.: 626,567

[22] Filed: Apr. 2, 1996

Related U.S. Application Data

[63] Continuation of Ser. No. 130,195, Oct. 1, 1993, Pat. No. 5,539,368.

[30] Foreign Application Priority Data

Oct. 7, 1992 [JP] Japan ..... 4-267759

[51] Int. Cl.[6] ..... H01F 7/20; G03G 15/09

[52] U.S. Cl. ..... 335/302; 399/257; 335/284

[58] Field of Search ..... 335/284, 302, 335/303, 306; 310/152–156; 118/657, 658; 355/251, 252, 253; 399/257

[56] References Cited

U.S. PATENT DOCUMENTS

| | | | |
|---|---|---|---|
| 3,402,698 | 9/1968 | Kojima et al. | 399/277 |
| 4,331,100 | 5/1982 | Mochizuki et al. | 118/657 |
| 4,547,758 | 10/1985 | Shimizu et al. | 335/302 |
| 5,089,060 | 2/1992 | Bradley et al. | 148/103 |
| 5,091,021 | 2/1992 | Perry et al. | 148/103 |
| 5,200,729 | 4/1993 | Soeda et al. | 335/284 |

*Primary Examiner*—Lincoln Donovan
*Assistant Examiner*—Raymond Barrera
*Attorney, Agent, or Firm*—Finnegan, Henderson, Farabow, Garrett & Dunner

[57] ABSTRACT

The magnet roll of the present invention includes a shaft and a permanent magnet member fixed to the shaft, the permanent magnet member being composed of a hollow, cylindrical magnet body, and a magnetic pole piece fixed to a recess of the hollow, cylindrical magnet body, the hollow, cylindrical magnet body having a plurality of axially extending magnetic poles arranged circumferentially on the surface, the magnetic pole piece being provided with two magnetic poles having the same polarity for constituting a developing magnetic pole, and a thermally demagnetized portion being formed substantially at a center of the developing magnetic pole such that the permanent magnet member generates a magnetic flux density distribution having two peaks of the same polarity at a position of the developing magnetic pole.

2 Claims, 3 Drawing Sheets

Magnetic Flux Density Distribution

Magnetic Flux Density Distribution

Magnetic Flux Density Distribution

Magnetic Flux Density Distribution

Magnetic Flux Density Distribution

MAGNET ROLL AND METHOD OF PRODUCING SAME

This is a continuation of application Ser. No. 08/130,195, filed Oct. 1, 1993, now U.S. Pat. No. 5,539,368.

BACKGROUND OF THE INVENTION

The present invention relates to a magnet roll for use as a developing roll in electrophotography and electrostatic recording, etc., and a method of producing such a magnet roll. In particular, it relates to a magnet roll comprising a permanent magnet member fixed to a shaft and having a plurality of magnetic poles which extend axially along the shaft and are arranged circumferentially on a surface of the magnet roll so as to generate an improved magnetic flux density distribution at a developing magnetic pole opposing an image-bearing member, and a method of producing such a magnet roll.

In conventional electrophotography and electrostatic recording, etc., a magnet roll used as a developing roll generally has a structure as shown in FIG. 5. The magnet roll comprises an integral, hollow cylindrical permanent magnet member 1 constituted by a sintered magnet of hard ferrite, and a shaft 2 disposed at a center of the permanent magnet member 1, the permanent magnet member 1 being concentrically fixed to the shaft 2. A hollow sleeve 3 is arranged around the permanent magnet member 1 such that the sleeve 3 and the permanent magnet member 1 are rotatable relative to each other.

The permanent magnet member 1 is provided with a plurality of magnetic poles having alternating polarities $S_1$, $N_1$, $S_2$, $N_2$ on an outer surface, which magnetic poles extend axially along the shaft 2 and are arranged circumferentially at an equal or unequal interval. Rotatably supported by both ends of the shaft 2 via bearings (not shown) is a support member to which the sleeve 3 is mounted. Incidentally, the support member and the sleeve 3 are made of non-magnetic materials such as aluminum alloys, stainless steel, etc. The permanent magnet member 1 preferably has an outer diameter of 18–60 mm and a length of 200–350 mm.

In the magnet roll having the above structure, the permanent magnet member 1 and the sleeve 3 are rotated relative to each other, so that a magnetic developer attracted onto a surface of the sleeve 3 by a magnetic attraction force of the permanent magnet member 1 is conveyed to a developing region in which the magnetic developer is formed into magnetic brush (not shown) for carrying out the development of latent image on the image-bearing member facing the developing region.

In the production of the above permanent magnet member 1, a magnetizing yoke having a magnetizing coil is usually used, and pulse current is applied to the coil to form predetermined magnetic poles on the permanent magnet member 1. In this case, the difference in permeability between the magnetizing yoke made of a ferromagnetic material and the air is not so large as the difference in electric conductivity between them. Accordingly, a part of the magnetic flux for magnetization is leaked, failing to provide the permanent magnet member 1 with a steep magnetic flux density distribution having a large gradient.

FIG. 6 shows one example of the magnetic flux density distribution near a developing magnetic pole in the conventional permanent magnet member. Even though the pulse current is applied to the magnetization coil, the permanent magnet member would be provided at a developing magnetic pole with a magnetic flux density distribution having a small gradient as shown by the solid line in FIG. 6. As a result, it has been impossible to provide the permanent magnet member with magnetic poles whose magnetic flux density distribution is as steep as shown by the broken line in FIG. 6.

Next, in order to increase the developing efficiency, it is effective to increase the density of the magnetic brush and the contact width between the magnetic brush and the image-bearing member. For this purpose, it was proposed to shape the developing magnetic pole as shown in FIG. 7 (for instance, U.S. Pat. No. 4,331,100). In FIG. 7, a permanent magnet member 1 is composed of a magnet body 11 made of an isotropic ferrite magnet material and a magnetic pole piece 12 made of an anisotropic ferrite magnet material and having a recess 13 on the surface thereof.

FIG. 8 shows an example of a magnetic flux density distribution of the permanent magnet member 1 of FIG. 7 near a developing magnetic pole. In this permanent magnet member 1, the magnetic flux density is larger than those of other magnetic poles, and the magnetic flux density distribution has two peaks near the developing magnetic pole. Accordingly, the magnetic brush produced by this permanent magnet member 1 can be brought into contact with the image-bearing member in a larger contact area than in the case of the permanent magnet member shown in FIG. 5, leading to a higher developing efficiency and the prevention of uneven development and blurring. Also, it enables a so-called jumping development.

However, to form the recess 13 on the surface of the permanent magnet member 1, it is necessary to cut the permanent magnet member 1 with a diamond grinder. In this case, since the ferrite magnet material constituting the magnetic pole piece 12 is hard and brittle, it is difficult to work the magnetic pole piece 12 precisely, necessitating a long working time with a high cost. In addition, ridges of the recess 13 are likely to be broken, resulting in a disturbed magnetic flux density distribution and so a degraded image quality.

On the other hand, by modifying the shape of the magnetization yoke, it may be possible to provide a developing magnetic pole generating a magnetic flux density distribution having two or more peaks. However, since a distance between the adjacent peaks is extremely small, and since there is some leaked magnetic flux at the time of magnetization, this cannot actually be applied to a commercial production.

OBJECT AND SUMMARY OF THE INVENTION

Accordingly, an object of the present invention is to provide a magnet roll free from the above problems and capable of increasing a contact area between the magnetic brush and the image-bearing member and/or easily achieving a steep magnetic flux density distribution having a large gradient near the developing magnetic pole.

Another object of the present invention is to provide a method of producing such a magnet roll.

To achieve the above objects, the present invention provides a magnet roll comprising a shaft and a hollow, cylindrical permanent magnet member fixed to the shaft, the permanent magnet member having a plurality of magnetic poles extending axially and disposed at a certain interval circumferentially on a surface of the permanent magnet member, a thermally demagnetized portion being formed near part of the magnetic poles.

The present invention also provides a method of producing a magnet roll comprising a shaft and a hollow, cylindrical permanent magnet member fixed to the shaft, comprising magnetizing the permanent magnet member to have a plurality of magnetic poles extending axially and arranged circumferentially on a surface thereof; irradiating a laser beam to part of the magnetic poles to conduct a local heating at a temperature higher than the Curie temperature of the permanent magnet member, thereby forming a thermally demagnetized portion.

DETAILED DESCRIPTION OF THE INVENTION

The present invention will be described in detail below.

Figure 1:
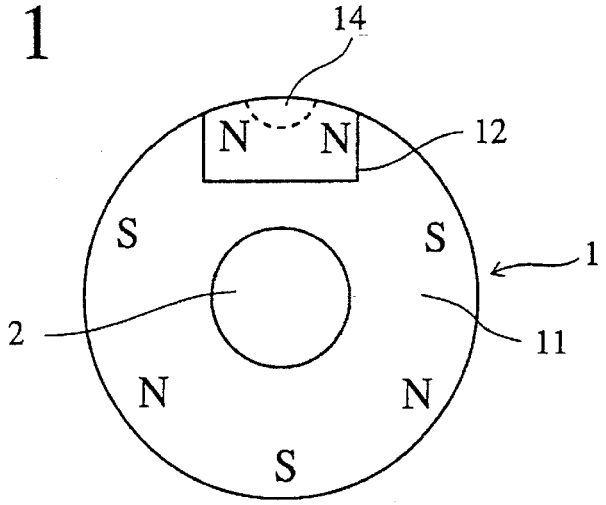
FIG. 1 is a schematic cross-sectional view showing a permanent magnet member of the magnet roll according to one embodiment of the present invention.
Figure 5:
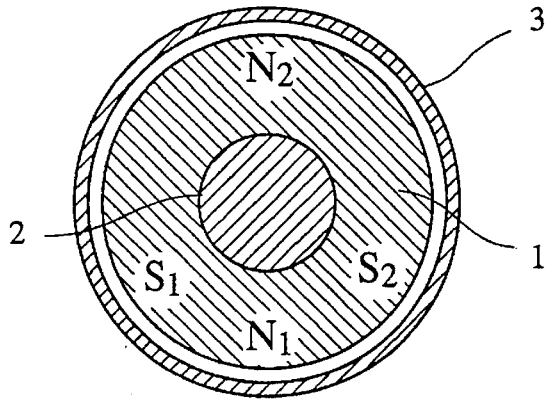
FIG. 5 (Prior Art)
FIG. 5 is a schematic cross-sectional view showing one type of the conventional magnet roll.
Figure 6:
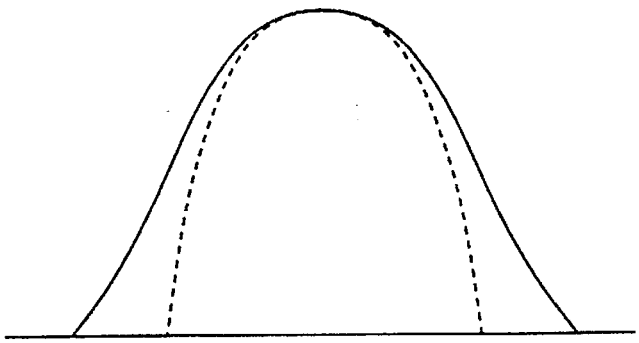
FIG. 6 is a graph showing a magnetic flux density distribution generated by the permanent magnet member shown in FIG. 5 near a developing magnetic pole.
Figure 7:
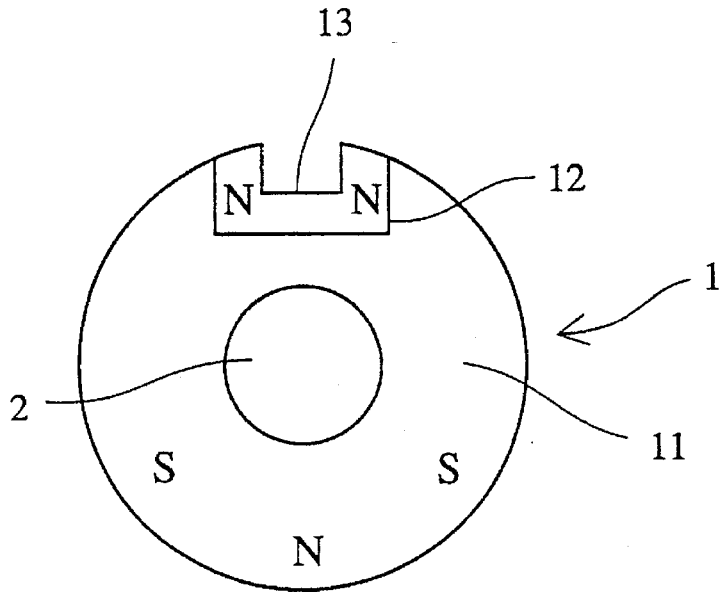
FIG. 7 (Prior Art)
FIG. 7 is a schematic cross-sectional view showing another type of the conventional magnet roll.
Figure 8:
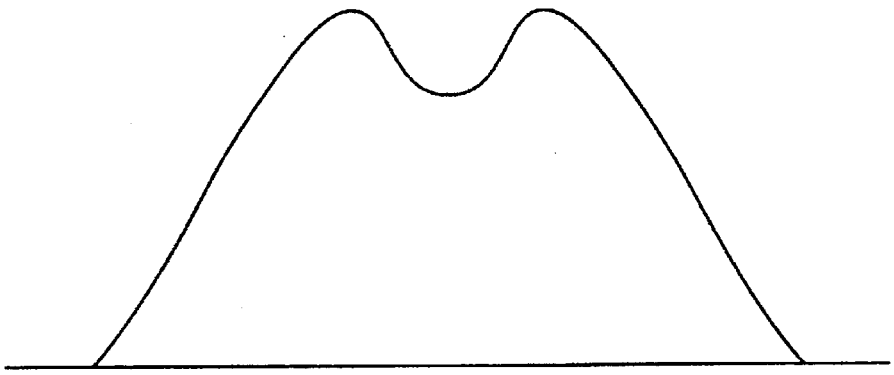
FIG. 8 is a graph showing a magnetic flux density distribution generated by the permanent magnet member shown in FIG. 7 near a developing magnetic pole.

FIG. 1 shows the permanent magnet member in the first embodiment of the present invention, in which the same reference numerals are assigned to the same parts and portions as in FIG. 5. In the typical example shown in FIG. 1, a hollow, cylindrical permanent magnet member 1 is fixed to a shaft 2 made of stainless steel and having an outer diameter of 10 mm and a length of 350 mm. The permanent magnet member 1 is composed of a hollow, cylindrical magnet body 11 made of an isotropic ferrite magnet material (YBM-3 available from Hitachi Metals, Ltd.) and having an outer diameter of 22 mm, an inner diameter of 10 mm and a length of 220 mm, and a magnetic pole piece 12 made of an anisotropic ferrite magnet material (YBM-2B available from Hitachi Metals, Ltd.) and having a width of 7 mm, a maximum thickness of 5 mm and a length of 220 mm. The magnetic pole piece 12 is fitted in and bonded to a recess of the hollow, cylindrical magnet body 11 by an epoxy adhesive. The hollow, cylindrical magnet body 11 is magnetized to have five magnetic poles S, N, S, N and S alternately arranged in the circumferential direction of the permanent magnet member 1, and the magnetic pole piece 12 is magnetized to have two magnetic poles of the same polarity N, N. Accordingly, there are apparently six magnetic poles arranged non-symmetrically on the permanent magnet member 1. Incidentally, both of the above ferrite magnet materials have a Curie temperature of about 460° C.

Figure 2:
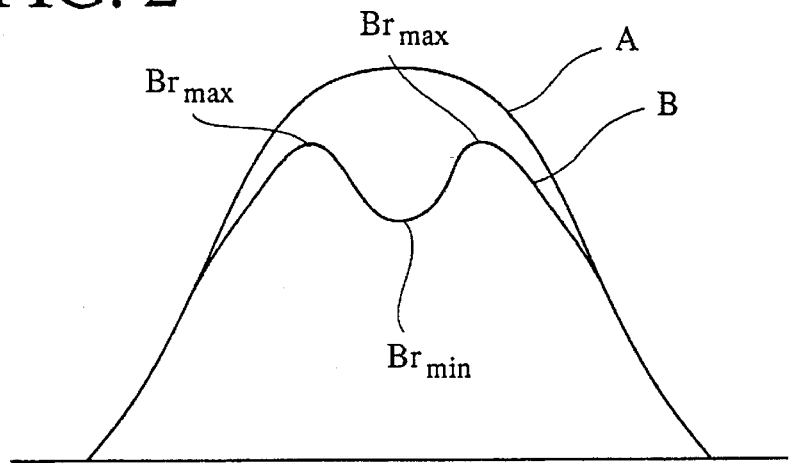
FIG. 2 is a graph showing a magnetic flux density distribution generated by the permanent magnet member shown in FIG. 1 near a developing magnetic pole.

The measurement of a magnetic flux density distribution near a developing magnetic pole on the above permanent magnet member 1 has revealed that a magnetic flux density distribution at a position apart from the magnetic pole piece 12 by 1 mm (corresponding to a sleeve surface) is in a one-peak shape as shown by the curve A in FIG. 2. The maximum magnetic flux of this magnetic flux density distribution is 1350 G. By irradiating a $CO_2$ laser beam of 1 kW to a center portion of the magnetic pole piece 12 at a spot diameter of 1.0 mm and moving the laser beam axially at a speed of 50 mm/second to conduct spot heating at a temperature higher than the Curie temperature, a thermally demagnetized portion 14 is formed in the magnetic pole piece 12. With this thermally demagnetized portion 14, the one-peak magnetic flux density distribution A is converted to a two-peak magnetic flux density distribution B as shown in FIG. 2. The two-peak magnetic flux density distribution B has a maximum magnetic flux density $Br_{max}$ of 1200 G and a minimum magnetic flux density $Br_{min}$ of 800 G between the two peaks.

The change of the magnetic flux density was investigated by grinding the thermally demagnetized portion 14 shown in FIG. 1. As a result, it has been found that the thermally demagnetized portion 14 has a width of about 3 mm in the circumferential direction and a depth of about 1.5 mm. Thus, it is presumed that this thermally demagnetized portion 14 has a substantially semi-circular or convex lens-shaped cross section. The width and the depth of the thermally demagnetized portion 14 may be controlled by adjusting the spot diameter and the axial moving speed of the laser beam.

Figure 3:
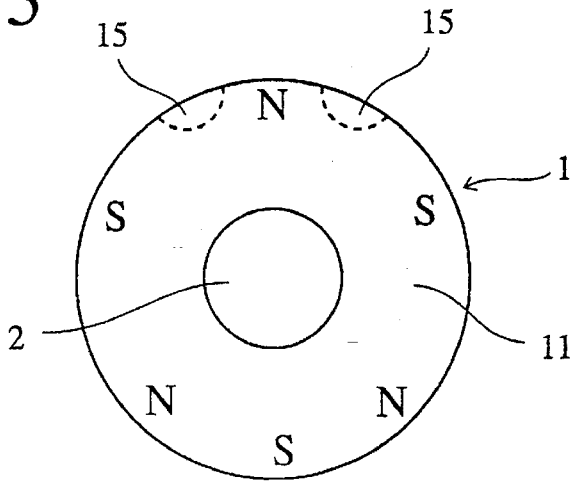
FIG. 3 is a schematic cross-sectional view showing a permanent magnet member of the magnet roll according to another embodiment of the present invention.

FIG. 3 shows another permanent magnet member of the present invention. In this figure, the same reference numerals are assigned to the same parts. The permanent magnet member 1 shown in FIG. 3 consists only of a magnet body 11 made of the same isotropic ferrite magnet material (YBM-3 available from Hitachi Metals, Ltd.) as in FIG. 1, and is magnetized to have non-symmetric six magnetic poles.

Figure 4:
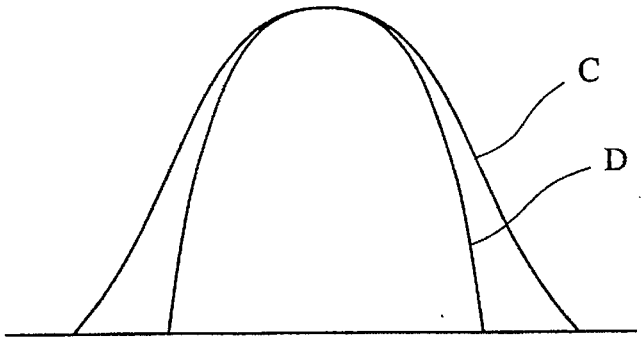
FIG. 4 is a graph showing a magnetic flux density distribution generated by the permanent magnet member shown in FIG. 3 near a developing magnetic pole.

The measurement of a magnetic flux density distribution near a developing magnetic pole on the above permanent magnet member 1 of FIG. 3 has revealed that a magnetic flux density distribution at a position apart from the magnet body 11 by 1 mm (corresponding to a sleeve surface) is in a one-peak shape having a small gradient as shown by the curve C in FIG. 4. The maximum magnetic flux density in this magnetic flux density distribution C is 850 G. By irradiating a $CO_2$ laser beam to both sides of the developing magnetic pole of the permanent magnet member 1 in the same manner as in FIG. 1, thermally demagnetized portions 15, 15 are formed. With these thermally demagnetized portions 15, 15, the small-gradient, one-peak magnetic flux density distribution C is converted to a large-gradient, one-peak magnetic flux density distribution D as shown in FIG. 4. Incidentally, the thermally demagnetized portion 15 may be formed only on one side of the developing magnetic pole.

In the above embodiments, the permanent magnet member and the magnetic pole piece are made of ferrite magnet materials. However, it should be noted that the same effects can be obtained by forming them with other magnet materials. Also, with other surface shapes of the permanent magnet member than the cylindrical shape shown in the attached figures, the same effects can be obtained. Further, the thermally demagnetized portion may be formed not only near the developing magnetic pole but also near the other magnetic poles or ends thereof. The thermally demagnetized portion may be formed in a linear shape or in a spiral or sinusoidal shape.

As described above in detail, the magnet roll having the above structure according to the present invention shows the following effects:

(1) Since a magnetic flux density distribution having a plurality of peaks of the same polarity can be easily obtained near the developing magnetic pole, it is possible to increase a contact width between the magnetic brush and the image-bearing member, resulting in improved developing efficiency.

(2) Since there is no necessity of forming a recess on a surface of the permanent magnet member at a position of a developing magnetic pole unlike the conventional permanent magnet member, the working of the permanent magnet member is easy without any trouble even when the permanent magnet member is made of a hard and brittle magnet material, resulting in greatly improved reliability.

(3) By forming a thermally demagnetized portion on at least one circumferential side of the developing magnetic pole, a steep magnetic flux density distribution can be obtained. Accordingly, the action of preventing the scattering of excess toner (magnetic toner) and suppressing the adhesion and scattering of carrier is increased.

(4) In a narrow area near the developing magnetic pole, the magnetic flux density distribution having a plurality of peaks of the same polarity is easily formed with high accuracy by means of machining.

(5) The steep magnetic flux density distribution can easily be obtained, which has been impossible with the conventional magnetization yoke.

What is claimed is:

1. A developing magnet roll comprising a shaft and a hollow, cylindrical permanent magnet member fixed to said shaft, said permanent magnet member having:

magnetic brush forming means comprising a plurality of magnetic poles extending axially and disposed at a certain interval circumferentially on a surface of said permanent magnet member; and a thermally demagnetized portion being formed on at least one circumferential side of a developing magnetic pole such that said permanent magnet member generates a steep magnetic flux density distribution at a position of said developing magnetic pole.

2. The developing magnet roll according to claim 1, wherein said hollow, cylindrical permanent magnet member is made of an isotropic ferrite magnet material, and said thermally demagnetized portion is formed on both circumferential sides of said developing magnetic pole.

* * * * *